US006206780B1

(12) United States Patent
Awada

(10) Patent No.: US 6,206,780 B1
(45) Date of Patent: Mar. 27, 2001

(54) MULTI POKER

(76) Inventor: Yehia Awada, 3982 Roundwood St., Las Vegas, NV (US) 89117

( * ) Notice: Subject to any disclaimer, the term of this patent is extended or adjusted under 35 U.S.C. 154(b) by 0 days.

(21) Appl. No.: 09/032,808

(22) Filed: Mar. 2, 1998

(51) Int. Cl.[7] ..... A63F 9/24
(52) U.S. Cl. ..... 463/13; 273/293
(58) Field of Search ..... 463/13, 20; 273/143 R, 273/292, 303

(56) References Cited

U.S. PATENT DOCUMENTS 4,743,022 * 5/1988 Wood ..... 273/85
5,725,216 * 3/1998 Jones ..... 273/292
5,882,259 * 3/1999 Holmes, Jr. ..... 463/1

* cited by examiner 3

*Primary Examiner*—Valencia Martin-Wallace
*Assistant Examiner*—Julie Kasick
(74) *Attorney, Agent, or Firm*—Leonard Weiss

(57) ABSTRACT

A player deposits money into a video poker machine to cause the machine to provide a display of a video image of a five card stud poker hand. The machine then disgorges a five card stud payout in accordance with a five card stud payout schedule. The player has an option of causing the machine to provide a video representation of an exchange any or all of the cards of the five card stud poker hand for randomly selected cards from the deck, whereby the machine provides a video image of a draw poker hand. The machine then disgorges a five card draw payout to the player in accordance with a five card draw payout schedule. The machine is then operable to provide a video display of an image of the draw poker hand augmented by two randomly selected cards. A seven card stud payout is then disgorged in accordance with a seven card stud payout schedule.

1 Claim, 4 Drawing Sheets

MULTI POKER

BACKGROUND OF THE INVENTION

1. Field of Invention

This invention is in the general field of casino gaming and, more particularly, relates to playing a poker game on a video poker machine.

2. Description of the Prior Art

Poker is the most frequently played card game in the United States. Moreover, poker has a gambling aspect whereby a player is permitted to wager that he holds a poker hand that is superior to poker hands held by all other players in the game. Without the gambling aspect, poker would be one of the least frequently played card games.

What is arguably the earliest form of poker was played with a deck of twenty cards during the 1830's on Mississippi river boats. Currently, there are approximately 100 variations of poker, most of which are played with a conventional deck of 52 cards. Typically, the number of players in a poker game is from two to eight.

An invariant feature of almost all Poker games is that a poker hand is comprised of five cards. The value of the hand is determined by its rank. The player with the highest ranking hand is usually the winner. The rankings of poker hands, in descending order, are given as:

ROYAL FLUSH, (Ace, King, Queen, Jack and 10 of the same suit);

STRAIGHT FLUSH, (five cards in sequence in any suit, i.e. Jack, 10, 9, 8, 7, of the same suit);

FOUR OF A KIND, (four Aces is highest);

FULL HOUSE, (THREE OF A KIND plus a PAIR, i.e., 10, 10, 10, King King);

FLUSH (Five cards of the same suit);

STRAIGHT (five cards in sequence but of different suits, i.e., (Jack, 10, 9, 8, 7);

THREE OF A KIND (Three cards of the same rank, i.e., three Aces);

TWO PAIRS (i.e., two Kings and two 10's);

ONE PAIR (two 5's); and

NO PAIR

A form of poker, known as video poker, is frequently played in a casino on a video poker machine. When video poker is played, there is no need for a dealer, a table, cheques, cards and a plethora of other items that are used in playing traditional poker. Therefore, video poker utilizes little of the casino's infrastructure. Because little of the casino's infrastructure is used, video poker is favored by the casino. It should be understood that at any given time only one player plays a given video poker machine.

The video poker machine typically includes a video display apparatus that is mounted within a console that has a coin slot and a control panel. At the start of the video poker game, a player deposits one or more coins into the coin slot.

When the coins are deposited, the player depresses a draw/deal pushbutton. In response to the depression of the draw/deal pushbutton, the apparatus provides a video display of five cards of an initial poker hand that are randomly selected from a standard deck of fifty two cards.

The player has an option of causing the apparatus to provide a video representation of an exchange of any or all of the five cards for randomly selected cards from the deck, thereby forming a video image of a final poker hand. The machine makes a payout based upon the rank of the final poker hand.

SUMMARY OF THE INVENTION

An object of the present invention is to provide a video poker game that captures the interest of a gaming patron.

According to a first specific embodiment, in response to money being deposited into a gaming machine, the machine provides a video display of an image of five cards that are randomly selected from a standard deck of fifty two cards. A five card stud payout is made to a player when the five cards are a stud poker hand that has a rank that is higher than a predetermined rank. The player has an option of causing the machine to provide a video representation of an exchange of any or all of the five cards for randomly selected cards from the deck, whereby the machine provides a video display of an image of a draw poker hand. A five card draw payout is made to the player when the draw poker hand has a rank that is higher than a predetermined rank. The player causes the machine to provide a video display of an image of seven cards; the draw poker hand augmented by two randomly selected cards from the deck. A seven card stud payout is made based upon the highest ranking five card poker hand that can be formed from the seven cards.

In a second specific embodiment, the player does not have the option of causing the video representation of the exchange. The machine provides a video display of an image of seven cards; the stud poker hand augmented by two randomly selected cards from the deck. The five and seven card stud payouts are made as in the first embodiment.

In a third specific embodiment, neither the five card stud hand nor the five card draw hand are augmented. The five card draw and five card stud payouts are made as in the first embodiment.

The invention combines the most interesting aspects of five card stud poker, five card draw poker and seven card stud poker, thereby providing a video poker game that is more likely to capture the interest of a gaming patron than video poker games of the prior art.

Other objects, features, and advantages of the invention should be apparent from the following description of the preferred embodiment thereof as illustrated in the accompanying drawing.

DESCRIPTION OF THE EMBODIMENTS

Figure 1:
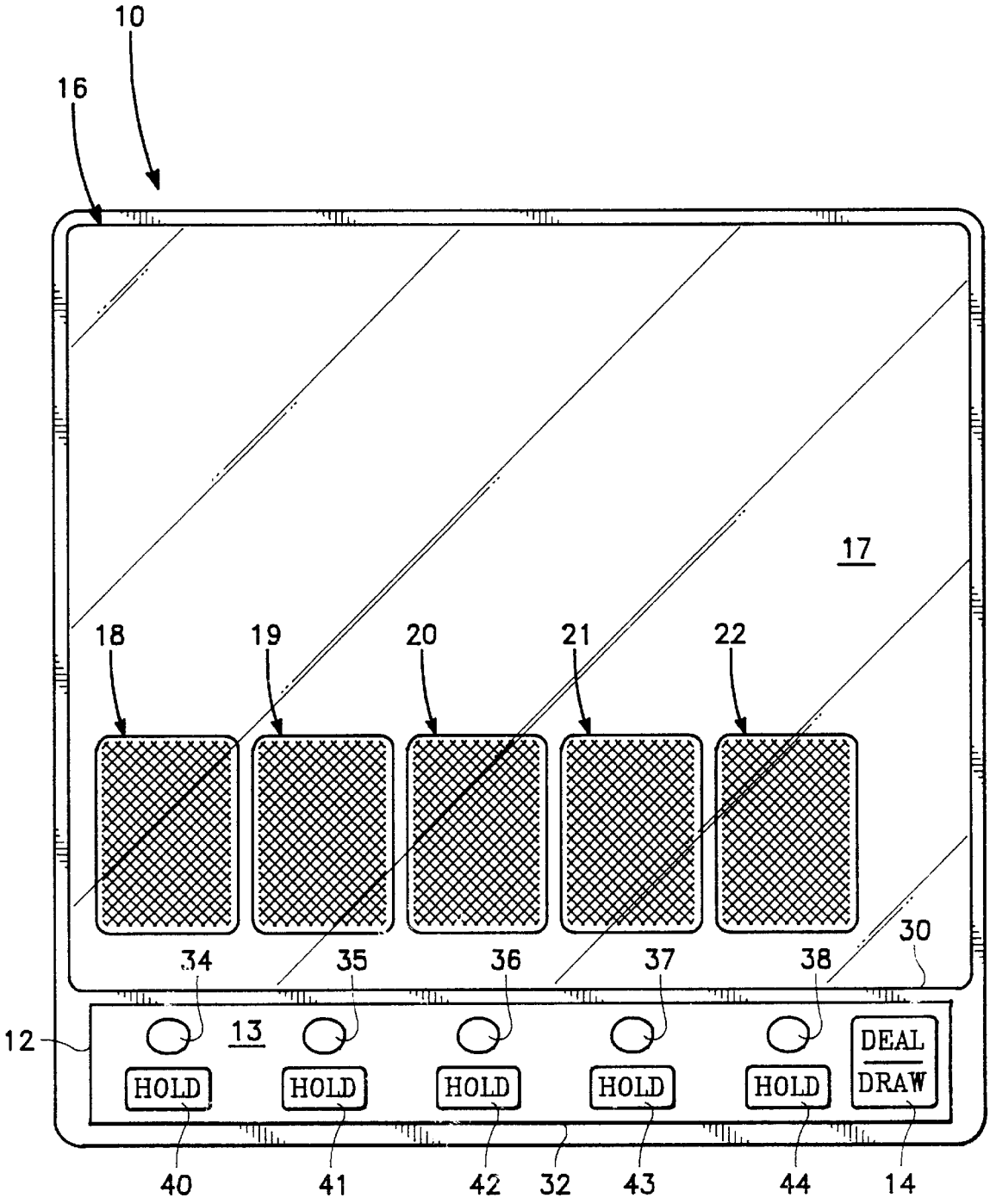
FIG. 1 is a simplified plan view of a video poker machine providing a video display of five cards face down.

As shown in FIG. 1, a video poker machine 10 includes a coin slot (not shown) wherein a player deposits money in the form of one or more coins. The machine 10 additionally includes a control panel 12 that has a rectangular face 13.

A draw/deal switch 14 is mounted on the panel 12. The switch 14 extends from the face 13.

A video unit 16 is fixedly connected to the panel 12. The unit 16 has a viewing surface 17 that is substantially in a coplanar relationship with the face 13.

After depositing the money, the player momentarily depresses the switch 14. In response to the depression of the switch 14, a video display of an image of playing cards 18–22, placed face down, is provided by the unit 16 on the surface 17.

Figure 2:
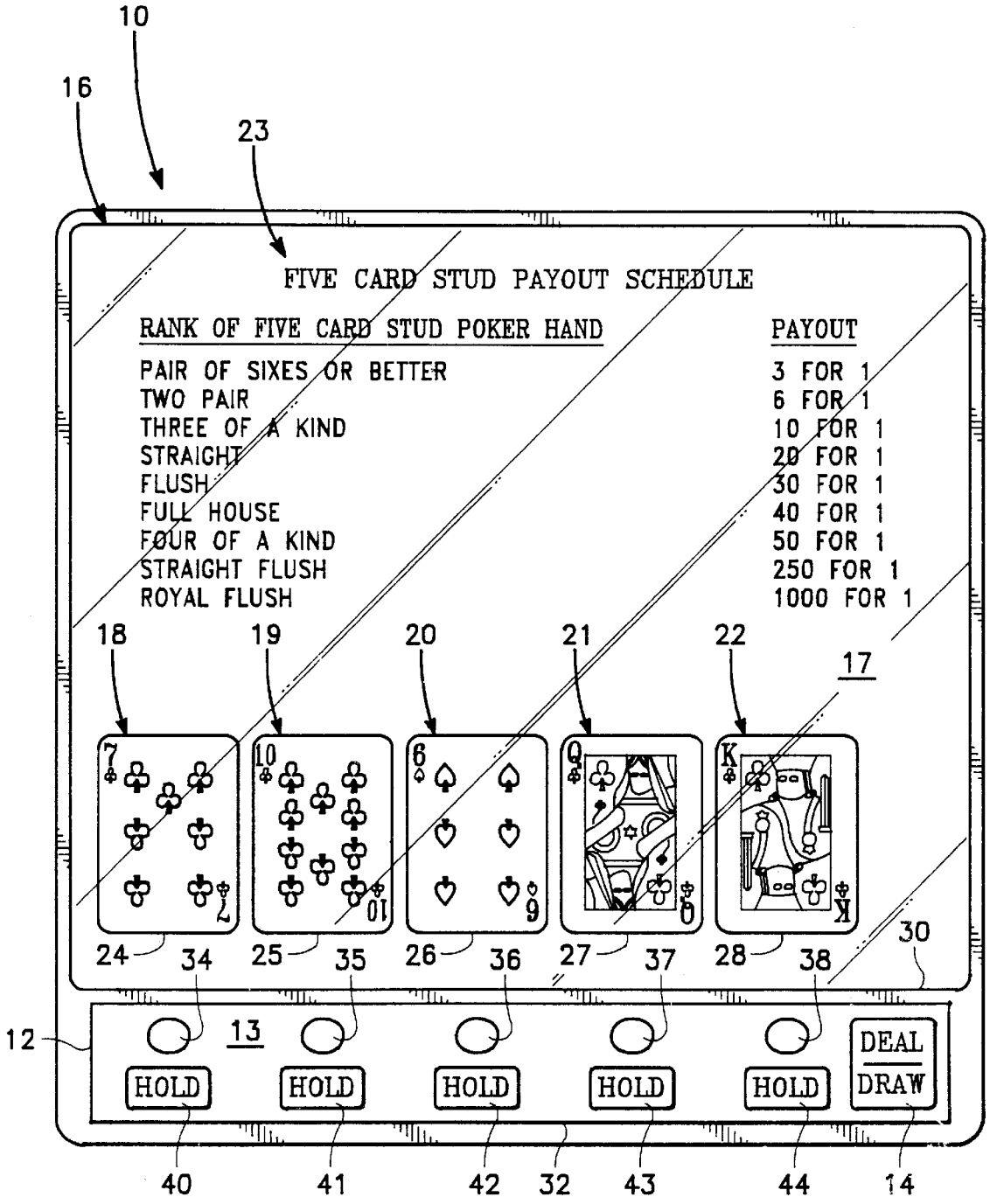
FIG. 2 is simplified plan view of the video poker machine providing a video display of the five cards face up.

As shown in FIG. 2, the player activates the game by again depressing the switch 14, thereby causing a video display of an image of the cards 18–22 placed face up. It should be understood that the cards 18–22 are randomly selected from a standard deck of cards. More particularly, the cards 18–22 are a seven of clubs, a ten of clubs, a six of spades, a queen of clubs and a king of clubs, respectively. The cards 18–22 are a five card stud poker hand.

In addition to the image of the cards 18–22, an image of a five card stud payout schedule 23 is provided on the surface 17. The machine 10 disgorges a five card stud payout to the player in accordance with the schedule 23.

The cards 18–22 are shown to have short side edges 24–28, respectively. In the image, the cards 18–22 are evenly spaced with the edges 24–28 colinearly aligned parallel to edges 30, 32 of the face 13.

The panel 12 has mounted thereon cylindrical pushbutton switches 34–38 that are aligned with centers of the cards 18–22, respectively. Additionally, a hold indicator lamp 40 is mounted on the panel 12 between the switch 34 and the edge 32. The lamp 40 has a rectangular lens with lettering of the word, hold, thereon. The switches 34–38 and the lamp 40 all extend from the face 13.

The lamp 40 is illuminated and darkened by successively depressing the switch 34. Indicator lamps 41–44, similar to the lamp 40, are mounted on the panel 12. The lamps 41–44 have spatial and functional relationships to the switches 31–34, respectively, similar to that described in connection with the lamp 40 and the switch 34.

The player has an option of causing a video representation of an exchange of any or all of the cards 18–22 for randomly selected cards from the deck to be provided on the surface 17. It should be understood that when a card is selected, it is different from any card that has previously been selected.

The purpose of the player causing a video representation of an exchange is to generate a video image of a poker hand with a higher rank than the rank of the five card stud poker hand. Since the card 20 is the six of spades and the cards 18, 19, 21 and 22 are all clubs, it is reasonable for the player to cause a video representation of an exchange the card 20 in hopes of generating a video image of a new card that is a club, whereby the cards 18, 19, 21, 22 and the new card are a draw poker hand having the rank of a flush.

The video representation of the exchange of the card 20 is accomplished by the player first depressing the pushbuttons 34, 35, 37, 38 to cause an illumination of the lamps 40, 41, 43, 44, thereby indicating that the video images of the cards 18, 19, 20, 22 are to be retained. When the lamps 40, 41, 43, 44 are illuminated, the player momentarily depresses the switch 14.

Figure 3:
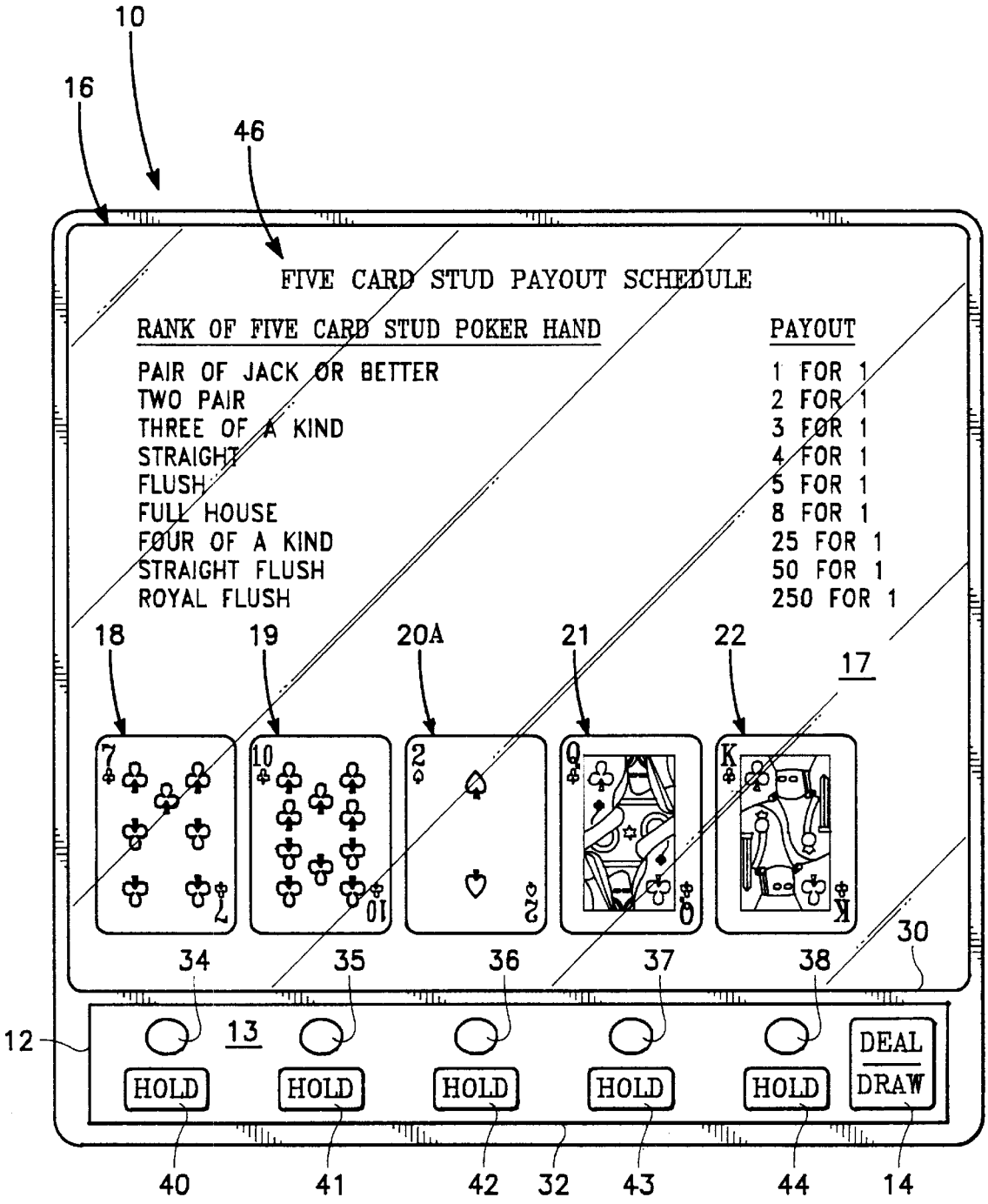
FIG. 3 is a simplified plan view of video poker machine providing a video display of cards of a draw poker hand.

As shown in FIG. 3, in response to the switch 14 being depressed, the image of the card 20 (FIG. 2) is replaced by an image of a playing card 20A, which is a two of spades. The cards 18, 19, 20A, 21, 22 are a five card draw poker hand in an alignment similar to that described in connection with the five card stud poker hand.

In addition to the image of the card 20 being replaced, the image of the schedule 23 (FIG. 2) is replaced by an image of a five card draw payout schedule 46. The machine 10 disgorges a five card draw payout to the player in accordance with the schedule 46.

Figure 4:
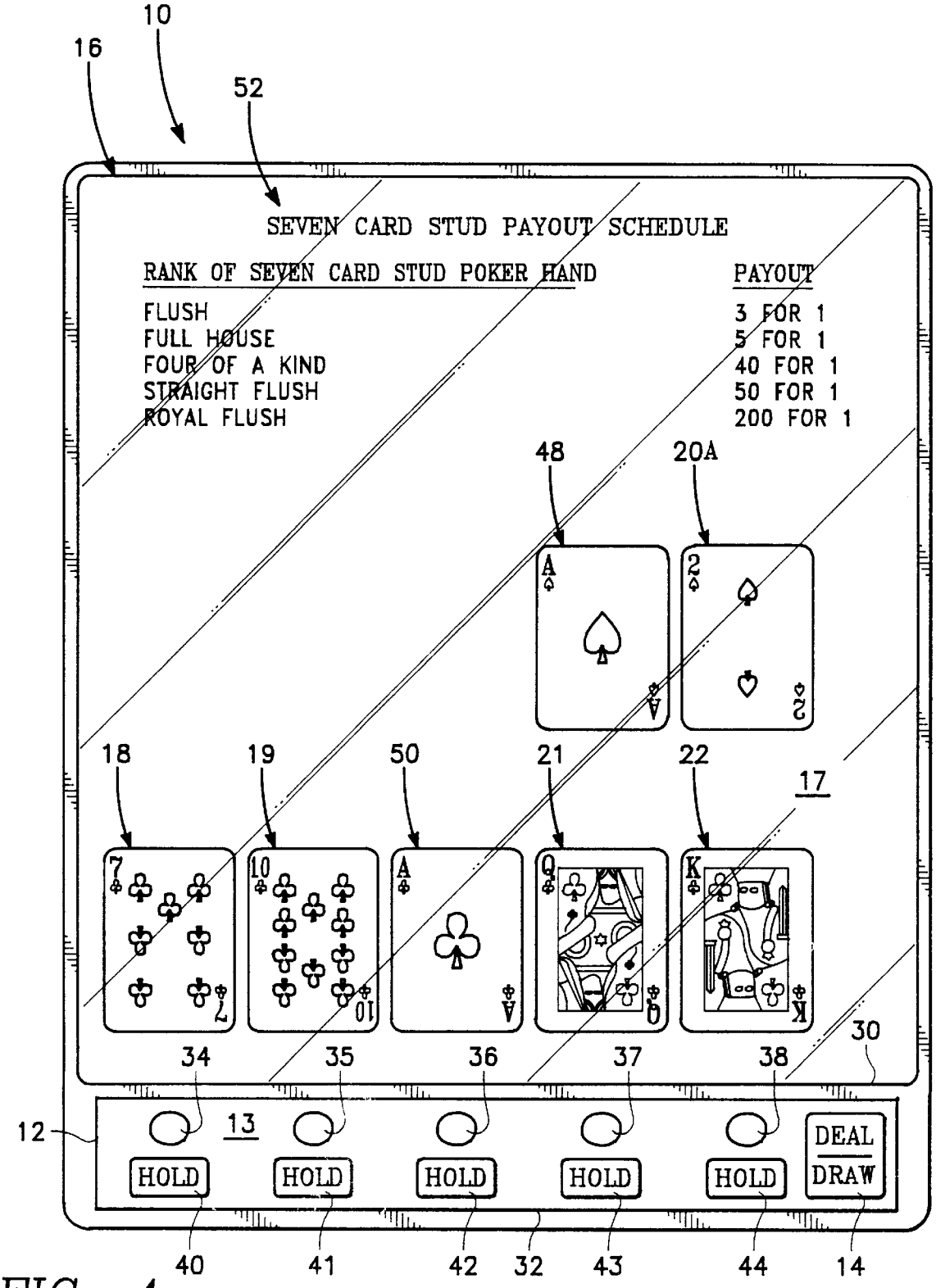
FIG. 4 is a simplified plan view of the video poker machine providing a video display of the draw poker hand augmented by two cards.

As shown in FIG. 4, after the replacement of the image of the card 20, the switch 14 is momentarily depressed to cause the image of the draw poker hand to be augmented by an image of a playing card 48 and an image of a playing card 50. The cards 48, 50 are an ace of spades and an ace of clubs respectively. The cards 18, 19, 20A, 21, 22, 48, 50 are a seven card stud poker hand.

In addition to the image of the draw poker hand being augmented, the image of the schedule 46 is replaced by an image of a seven card stud payout schedule 52. The machine 10 disgorges a seven card stud payout in accordance with the schedule 52.

It should be understood that the rank of the seven card stud poker hand is the rank of the highest ranking five card poker hand that can be formed from the seven card stud poker hand. Since the card 50 is a club, the seven card poker hand has the rank of a flush. The machine 10 automatically provides an image of the highest ranking five card poker in an alignment that is similar to the alignment of the five card stud and draw poker hands.

In one alternative embodiment, the image of the five card stud poker hand is augmented by images of two cards whereby the augmented five card stud poker hand is a seven card stud poker hand. The five and seven card payouts are disgorged as described hereinbefore.

In another alternative embodiment, neither of the images of the five card poker hands is augmented; only the five card stud and five card draw payouts are disgorged.

It should be understood that features, such as the use of a joker or any wild card may be used in embodiments of the invention. Additionally, a payout of a bonus for hands, such as four of a kind or better may be used in embodiments of the invention.

While the invention has been particularly shown and described with reference to embodiments thereof, it should be understood by those skilled in the art that changes in form and detail may be made therein without departing from the spirit and scope of the invention.

I claim:

1. The method of a player playing a game comprising the steps of:

providing a video display of an image of five cards that are randomly selected from a standard deck of fifty two cards;

making a five card stud payout to said player when said five cards are a five card stud poker hand that has a rank that is higher than a predetermined rank;

giving said player an option of causing a video representation of an exchange of any or all of said five cards for randomly selected cards from said deck to provide a video display of a draw poker hand;

making a five card draw payout to said player when said draw poker hand has a rank that is higher than a predetermined rank;

providing an image of said draw poker hand augmented by two randomly selected cards from said deck thereby providing an image of seven cards; and making a seven card stud payout to said player based upon the highest ranking five card poker hand that can be formed from said seven cards.

* * * * *